US006943748B2

(12) United States Patent
Durham et al.

(10) Patent No.: US 6,943,748 B2
(45) **Date of Patent: *Sep. 13, 2005**

(54) MULTIBAND POLYGONALLY DISTRIBUTED PHASED ARRAY ANTENNA AND ASSOCIATED METHODS

(75) Inventors: Timothy E. Durham, Palm Bay, FL (US); Griffin K. Gothard, Satellite Beach, FL (US); Anthony M. Jones, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 62 days.

This patent is subject to a terminal disclaimer.

(21) Appl. No.: 10/703,132

(22) Filed: Nov. 6, 2003

(65) Prior Publication Data

US 2005/0099357 A1 May 12, 2005

(51) Int. Cl.[7] ..... H01Q 9/28; H01Q 21/26; H01Q 13/00; H01Q 1/48

(52) U.S. Cl. ..... 343/795; 343/797; 343/776; 343/848

(58) Field of Search ..... 343/700 MS, 795, 343/776, 848, 847, 893, 778, 754

(56) References Cited

U.S. PATENT DOCUMENTS 4,081,803 A * 3/1978 Dempsey ..... 343/795
5,091,731 A * 2/1992 Rees ..... 343/700 MS
5,835,062 A * 11/1998 Heckaman et al. .. 343/700 MS
6,396,449 B1 * 5/2002 Osterhues et al. ..... 343/754
6,417,813 B1 7/2002 Durham ..... 343/753
6,512,487 B1 * 1/2003 Taylor et al. ..... 343/795
6,552,687 B1 * 4/2003 Rawnick et al. ..... 343/700 MS
6,744,411 B1 * 6/2004 Osterhues et al. ..... 343/754
6,856,297 B1 * 2/2005 Durham et al. ..... 343/795
2004/0155820 A1 * 8/2004 Sreenivas et al. ..... 34/700 MS
2005/0030245 A1 * 2/2005 Croswell et al. ..... 343/795
2005/0030246 A1 * 2/2005 Durham et al. ..... 343/795

* cited by examiner

*Primary Examiner*—Shih-Chao Chen
*Assistant Examiner*—Hung Tran Vy
(74) *Attorney, Agent, or Firm*—Allen, Dyer, Doppelt, Milbrath & Gilchrist, P.A.

(57) ABSTRACT

A phased array antenna includes a substrate, and dipole element arrays extending in concentric rings about an imaginary center point on the substrate. Each dipole element array includes dipole antenna elements arranged in an end-to-end relation and having a dipole size different than a dipole size of dipole antenna elements of at least one other dipole element array. A ground plane is adjacent the dipole element arrays, and a spacing between the dipole element arrays and the ground plane is different between the dipole element arrays having different size dipole antenna elements.

39 Claims, 14 Drawing Sheets

MULTIBAND POLYGONALLY DISTRIBUTED PHASED ARRAY ANTENNA AND ASSOCIATED METHODS

FIELD OF THE INVENTION

The present invention relates to the field of communications, and more particularly, to a multiband phased array antenna.

BACKGROUND OF THE INVENTION

Existing microwave antennas include a wide variety of configurations for various applications, such as satellite reception, remote broadcasting, or military communication. The desirable characteristics of low cost, light weight, low profile and mass producibility are provided in general by printed circuit antennas.

The simplest forms of printed circuit antennas are microstrip antennas wherein flat conductive elements, such as monopole or dipole antenna elements, are spaced from a single essentially continuous ground plane by a dielectric sheet of uniform thickness. An example of a microstrip antenna is disclosed in U.S. Pat. No. 6,417,813 to Durham, which is assigned to the current assignee of the present invention and is incorporated herein by reference in its entirety.

The antennas are designed in an array and may be used for communication systems requiring such characteristics as low cost, light weight and a low profile. The bandwidth of such antennas is about 10-to-1. However, a 10-to-1 bandwidth can be limiting for certain applications. For example, electronic warfare support measures (ESM) and electronic intelligence (ELINT) radar systems require antennas having a bandwidth typically greater than 20-to-1, which offers a higher probability of intercepting signals.

One approach for increasing the bandwidth of an array of dipole antenna elements is disclosed in U.S. Pat. No. 6,552,687 to Rawnick et al., which is also assigned to the current assignee of the present invention and is incorporated herein by reference in its entirety. The multiband phased array antenna in the '687 patent includes a first array of dipole antenna elements operating over a first frequency band, and a second array of dipole antenna elements operating over a second frequency band so that the phased array antenna is a multiband antenna.

The size of the dipole antenna elements in the first array is different from the size of the dipole antenna elements in the second array. Consequently, the ground plane spacing is different between the first and second arrays. One disadvantage of this configuration is that since the higher frequency dipole antenna elements are surrounded by the lower frequency dipole antenna elements, there is a gap or hole in the aperture distribution of the lower frequency dipole antenna elements. Consequently, the layout of the different size antenna elements in the '687 patent presents difficulties in controlling the antenna pattern since this gap or hole may have undesired effects, such as raising the sidelobe levels of the antenna. In addition, the fact that the physical aperture size does not change over a large bandwidth (approximately 10:1) means that the electrical size of the aperture will vary considerably over the band, making this approach unsuitable as a feed for a reflector.

A different type antenna that offers a wide bandwidth (greater than 20-to-1) is a spiral antenna. To cover multiple frequency bands, multiple spirals may be used, i.e., a spiral for each frequency band. However, the multiple spirals are non-concentric about the focal point of the antenna when operating as a feed for a reflector, which results in a loss of efficiency due to scan loss compared to that of a completely concentric aperture. In addition, another disadvantage is that the efficiency of spiral antennas is typically much less than 50% since their performance depends on an absorber-filled back cavity.

SUMMARY OF THE INVENTION

In view of the foregoing background, it is therefore an object of the present invention to provide a multiband antenna that has high efficiency while achieving a constant beamwidth and pattern control.

This and other objects, features, and advantages in accordance with the present invention are provided by a phased array antenna comprising a substrate, and a plurality of dipole element arrays extending in concentric rings about an imaginary center point on the substrate. Each dipole element array may comprise a plurality of dipole antenna elements arranged in end-to-end relation and having a dipole size different than a dipole size of dipole antenna elements of at least one other dipole element array.

The concentric rings of dipole element arrays may be symmetrically distributed about the imaginary center point. The concentric distribution of the dipole element arrays advantageously provides a constant beamwidth when operating the multiband phased array antenna as a reflector feed. This results from the fact that a different ring can be used for each of several different frequency bands of operation. The diameter of each ring can be chosen to have about the same electrical size in its operating band, resulting in relatively constant secondary pattern beamwidth from the reflector system for all of the frequency bands. In addition, since all of the arrays have the same phase center, there is no loss of efficiency due to scan loss resulting from the phase center of the array being offset from the focal point of the reflector. This loss is always present if multiple separate apertures are utilized (e.g. spirals) since they cannot occupy the same space.

A ground plane is adjacent the plurality of dipole element arrays and may have a different spacing therefrom in an outward direction from the imaginary center point. The different spacing between the ground plane and the plurality of dipole element arrays may increase from the imaginary center point towards an edge of the substrate. The slope of the ground plane does not necessarily have to be constant. For example, the slope of the ground plane may be logarithmic or exponential. In this case, position of the dipole element arrays may be adjusted accordingly to provide the preferred spacing between the ground plane and the respective dipole antenna elements based upon their size. A dielectric material is between the ground plane and the respective dipole antenna elements.

Each dipole antenna element may comprise a printed conductive layer. The plurality of dipole antenna elements are preferably sized and relatively positioned within each dipole element array so that the multiband phased array antenna has a total bandwidth equal to or greater than 20-to-1.

Each dipole antenna element comprises a medial feed portion and a pair of legs extending outwardly therefrom. Adjacent legs of adjacent dipole antenna elements may include respective spaced apart end portions having predetermined shapes and relative positioning to provide increased capacitive coupling between the adjacent dipole antenna elements. Each leg may comprise an elongated body portion, and an enlarged width end portion connected to an end of the elongated body portion. The spaced apart end portions in adjacent legs may comprise interdigitated portions.

The multiband phased array antenna may further comprise a respective impedance element electrically connected between the spaced apart end portions of adjacent legs of adjacent dipole antenna elements for further increasing the capacitive coupling therebetween. Alternately, a respective printed impedance element may be adjacent the spaced apart end portions of adjacent legs of adjacent dipole antenna elements for further increasing the capacitive coupling therebetween.

Another aspect of the present invention is directed to a method for making a multiband phased array antenna by providing a substrate, and forming a plurality of dipole element arrays extending in concentric rings about an imaginary center point on the substrate. Each dipole element array may comprise a plurality of dipole antenna elements arranged in end-to-end relation and has a dipole size different than a dipole size of dipole antenna elements of at least one other dipole element array.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime, double prime and triple prime notations are used to indicate similar elements in alternative embodiments.

Figure 1:
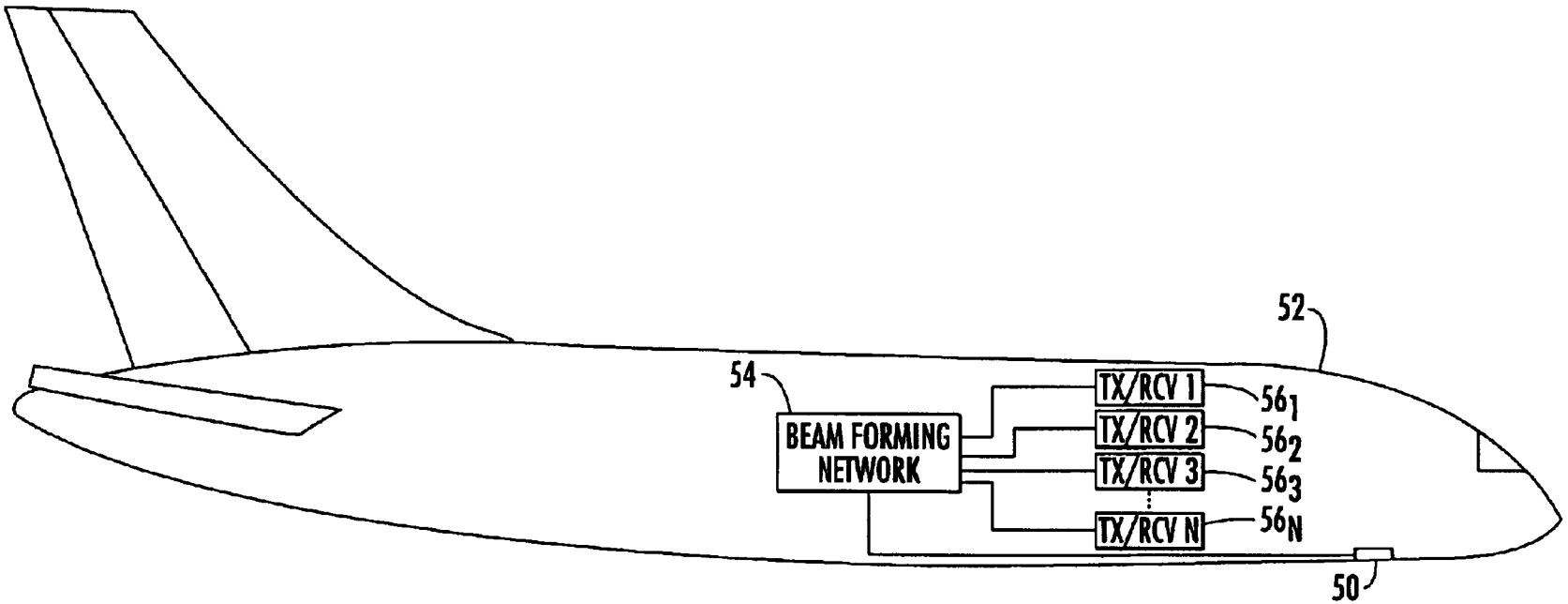
FIG. 1 is a schematic diagram illustrating a multiband phased array antenna mounted on an aircraft in accordance with the present invention.

Referring initially to FIG. 1, a multiband phased array antenna 50 in accordance with the present invention will now be described. One or more multiband phased array antennas 50 may be mounted on an aircraft 52, for example. The illustrated multiband phased array antenna 50 is connected to a beam forming network (BFN) 54 which is connected to a plurality of transceivers $\mathbf{56}_1$–$\mathbf{56}_n$.

Since the multiband phased array antenna 50 covers multiple frequency bands, each transceiver $\mathbf{56}_1$–$\mathbf{56}_n$ functions over one or more frequency bands. The BFN 54 controls the phase of the multiband phased array antenna 50 to create the desired sum and difference patterns, which forms the desired antenna beams, as readily understood by those skilled in the art. An example BFN 54 is a Butler matrix.

Figure 2:
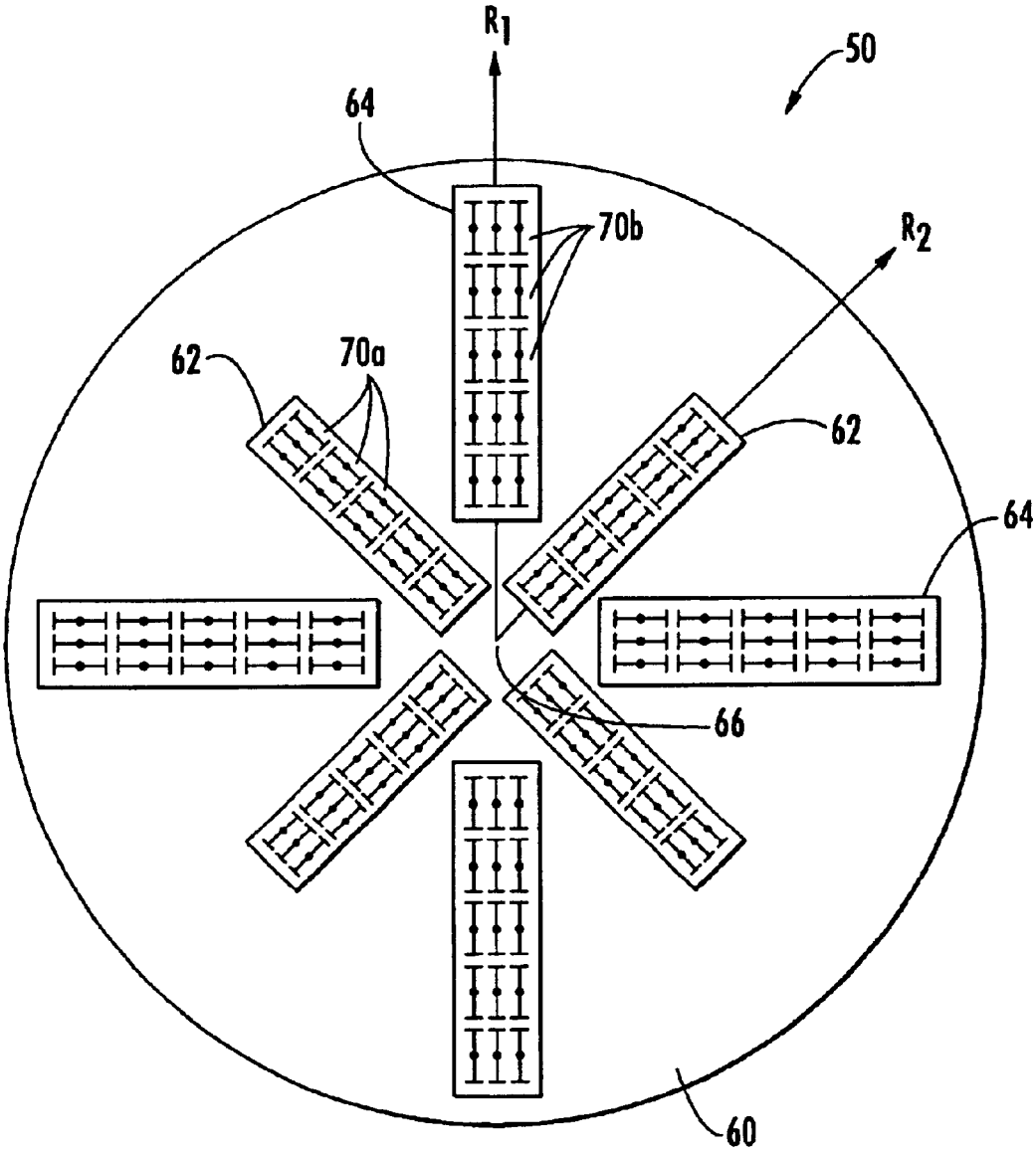
FIG. 2 is a top plan view of the multiband phased array antenna in accordance with the present invention.

One aspect of the multiband phased array antenna 50 comprises a substrate 60, and a plurality of dipole element arrays 62, 64 extending outwardly from an imaginary center point 66 on the substrate, as illustrated in FIG. 2. The plurality of dipole element arrays 62, 64 may be radially distributed from the imaginary center point 66, with the radial distribution being symmetrical. The radial distribution of the dipole element arrays 62, 64 advantageously provides no scan loss and therefore high efficiency when operating the multiband phased array antenna 50 as a reflector feed since all of the arrays use the same focal point, i.e., the imaginary center point 66. In addition, the pattern of the multiband phased array antenna 50 can be more easily controlled because the radial distribution of the dipole element arrays 62, 64 allows for a choice of one or more feed points. Different feed points correspond to different electrical sizes for the array. By choosing different feed points for different bands of operation, the electrical size may be maintained relatively constant over an extremely broad bandwidth. In addition, yet another benefit of the radial distribution is that it provides the polarization diversity required to obtain sum and difference patterns that are relatively azimuthally constant in amplitude if the proper beam forming network is utilized.

Each dipole element array 62, 64 comprises a plurality of dipole antenna elements 70*a*, 70*b* arranged in an end-to-end relation and having a dipole size different than a dipole size of dipole antenna elements of at least one other dipole element array. Each dipole element array 62, 64 is arranged in rows and columns, such as the 3×5 arrays illustrated in FIG. 2. The 3×5 arrays are for illustrative purposes, and the actual size of the arrays 62, 64 may vary depending on the intended application.

As will be discussed in greater detail below, the center column of dipole antenna elements 70*a*, 70*b* are active, whereas the outer columns of dipole antenna elements are passive. The passive elements in the outer columns allow the active elements in the center column to receive sufficient current, which is normally conducted through the dipole antenna elements 70*a*, 70*b* on the substrate 60.

The multiband phased array antenna 50 illustrated in FIG. 2 includes two sets of dipole element arrays 62, 64. These dipole element arrays 62, 64 are separated into high-frequency band arrays and low-frequency band arrays. Dipole element arrays 64 are the low-frequency band arrays, which may cover a frequency range of 4 to 18 GHz, for example. Dipole element arrays 62 are the high-frequency band arrays, which may cover a frequency range of 19 to 28 GHz, for example. In this example, the multiband phased array antenna 50 covers a total bandwidth of 7-to-1.

To increase the total bandwidth, additional dipole element arrays may simply be added to the substrate 60 to cover a different frequency range. For example, if the additional dipole element arrays (not shown) cover 1 to 4 GHz, then the total bandwidth is significantly increased to 28-to-1.

The size of the dipole antenna elements 70*b* in the low-frequency band arrays 64 is different than the size of the dipole antenna elements 70*a* in the high-frequency band arrays 62. In particular, the size of the dipole antenna elements 70*a* in the high-frequency band arrays 62 is less than the size of the dipole antenna elements 70*b* in the low-frequency band arrays 64.

Figure 3:
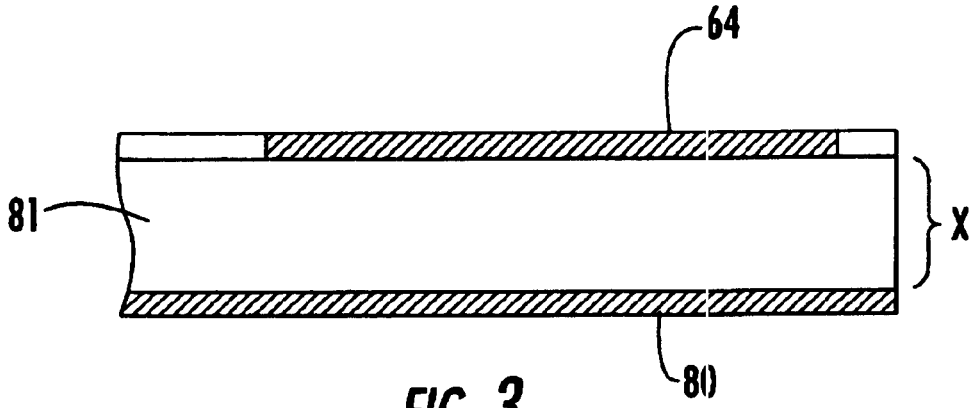
FIGS. 3 and 4 are cross-sectional views of the multiband phased array antenna as shown in FIG. 2 respectively taken along radial axes $R_1$ and $R_2$.
Figure 4:
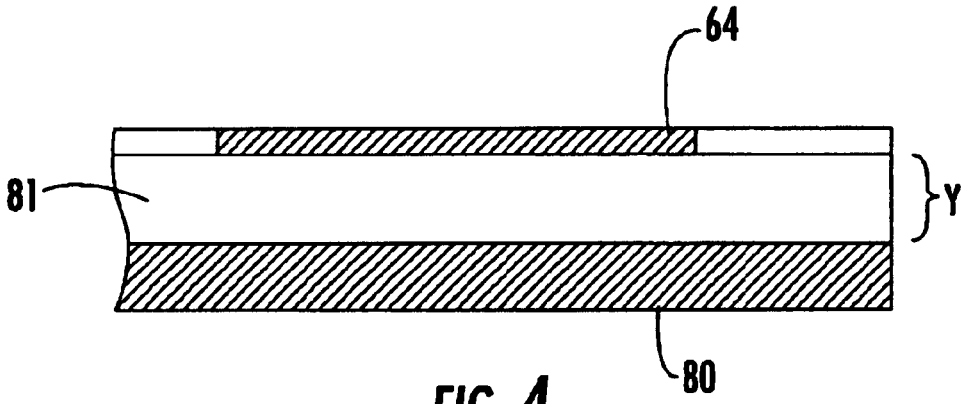

The multiband phased array antenna 50 further includes a ground plane 80. FIGS. 3 and 4 are cross-sectional views of the multiband phased array antenna 50 as shown in FIG. 2 respectively taken along radial axes $R_1$ and $R_2$. The spacing X of the ground plane 80 for the dipole antenna elements 70 in the low-frequency band arrays 64 is greater than the spacing Y of the ground plane for the dipole antenna elements in the high-frequency band arrays 62. The ground plane 80 is preferably spaced from the different size dipole element arrays 62, 64 less than about one-half a wavelength of a highest desired frequency within each respective array, as readily appreciated by those skilled in the art.

The different spacing between the ground plane 80 and the respective dipole antenna elements 70*a*, 70*b* may be provided by a plateau shaped ground plane. In other words, the ground plane 80 has a stepped shape or thickness between the low-frequency band arrays 64 and the high-frequency band arrays 62. A dielectric material 81 may be between the ground plane 80 and the respective dipole antenna elements 70.

Figure 5:
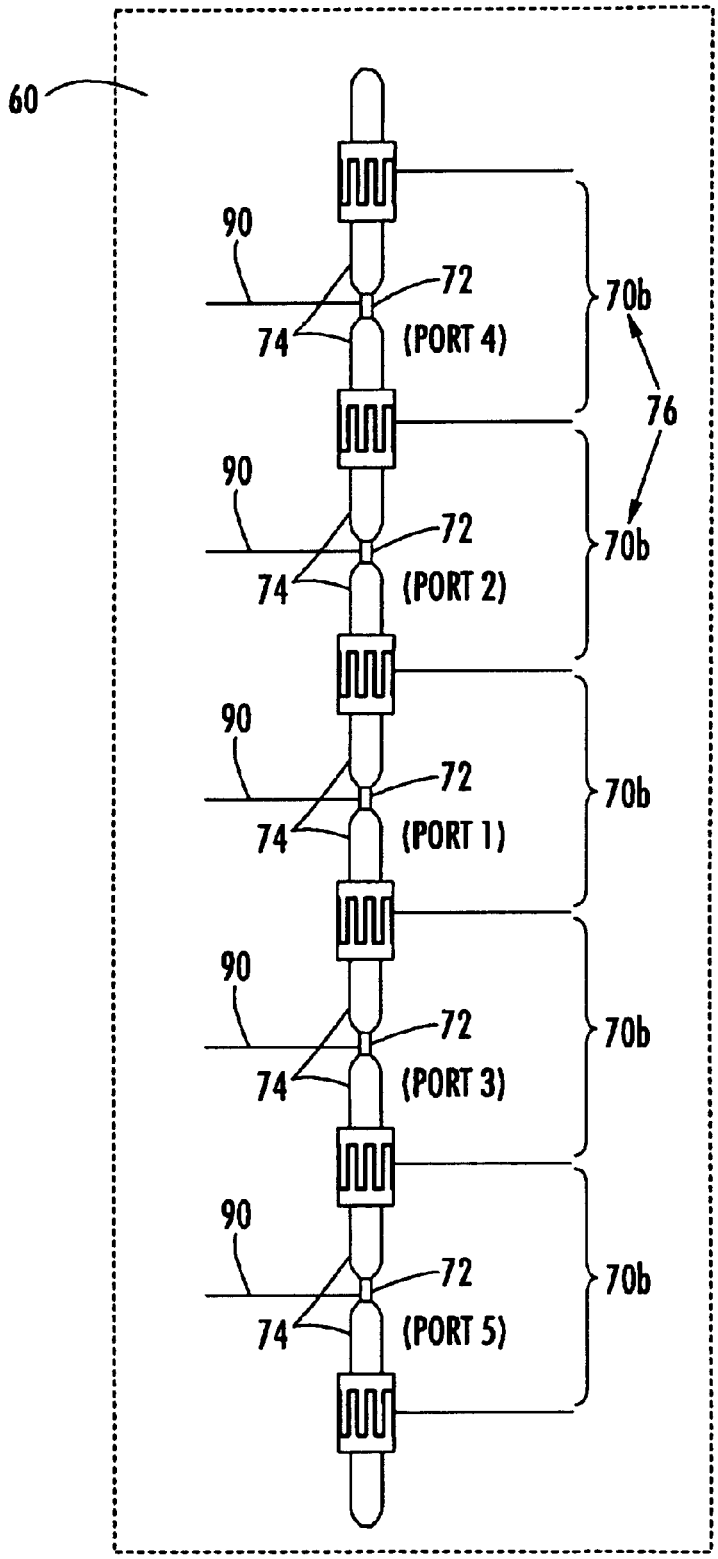
FIG. 5 is an enlarged schematic view of a center column of one of the dipole element arrays as shown in FIG. 2.

Referring now to FIG. 5, a plurality of feed lines 90 may be connected to the active dipole antenna elements 70*a*, 70*b* in each array 62, 64. As noted above, the center column of each array 62, 64 includes active dipole antenna elements 70*a*, 70*b*, whereas the outer columns include passive dipole antenna elements. This advantageously reduces the complexity of connecting the feed lines 90 to the dipole antenna elements in the multiband phased array antenna 50. The active dipole antenna elements 70*b* as shown in FIG. 5 represent the center column of a low-frequency band array 64. The feed 72 for each active dipole antenna element 70*b* therein may be referred to as a port. Consequently, the five active dipole antenna elements 70*b* have five ports 72 that may be connected to five separate feed lines 90.

Figure 6:
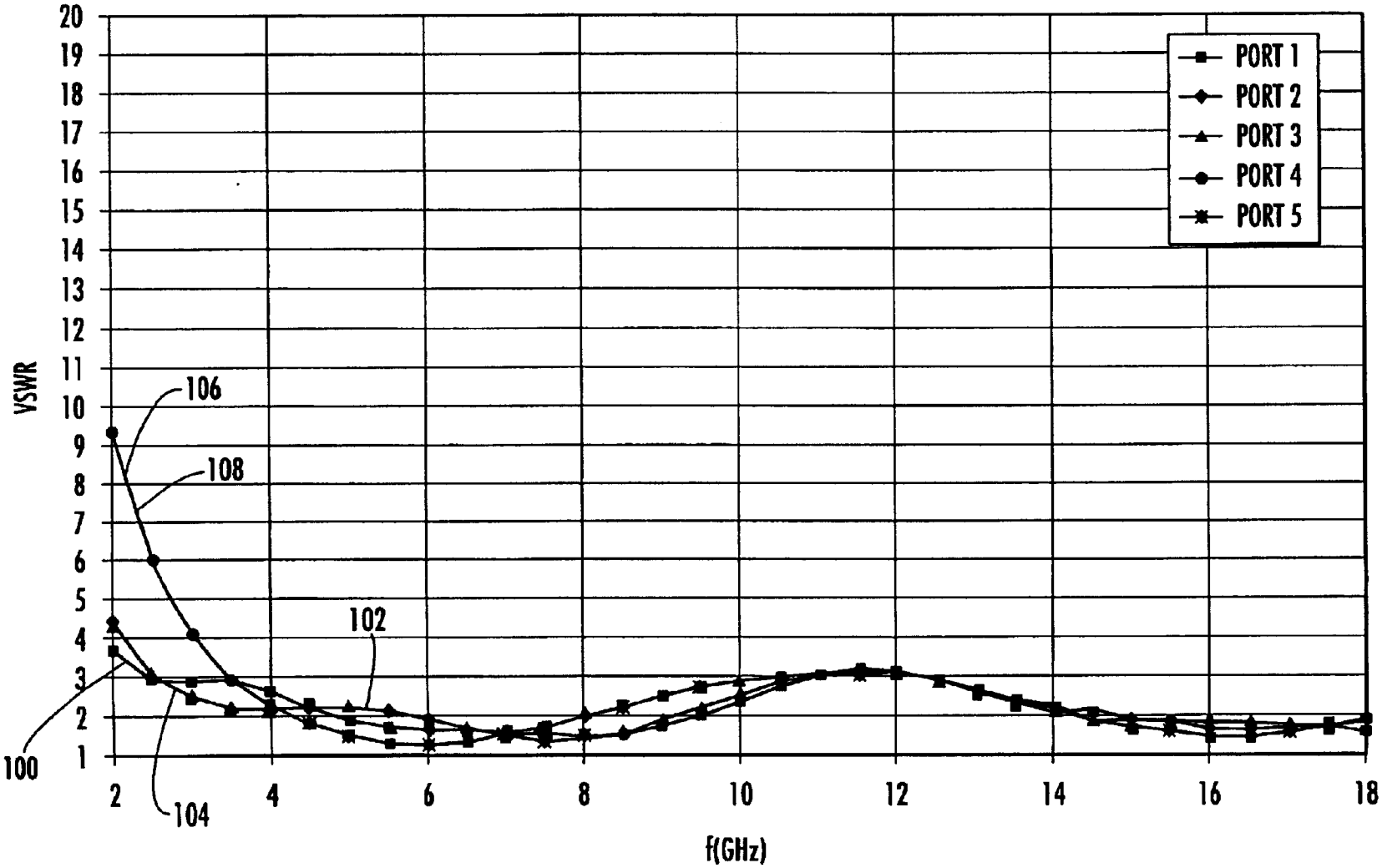
FIG. 6 is a plot of computed VSWR versus frequency for the low-frequency band arrays in the multiband phased array antenna as shown in FIG. 2.

FIG. 6 is a plot of VSWR versus frequency for the low-frequency band arrays 64 with respect to each of the five ports 72. Port 1 is represented by line 100, port 2 is represented by line 102, port 3 is represented by line 104, port 4 is represented by line 106 and port 5 is represented by line 108. Lines 106 and 108 overlap one another so that it appears that only one line represents both ports 4 and 5. Between 4 and 18 GHz, the VSWR for all five ports 72 is substantially the same when operating the multiband phased array 50 as a feed for a reflector. This results in a substantially constant beamwidth over the entire operating bandwidth of the array.

Between 2 and 4 GHz, however, the VSWR significantly increases for the outer ports (ports 4 and 5), whereas for the inner ports (ports 1, 2 and 3), the VSWR slightly increases. Each port 72 is a different radial distance from the phase center of the multiband phased array antenna—which is the imaginary center point 66 on the substrate 60.

Since the wavelength changes as the frequency changes, it is preferred that the multiband phased array antenna 50 remains electrically the same for the different size dipole antenna elements 70*a*, 70*b*. The radial distance of each port 72 from the phase center 66 determines the beamwidth. Consequently, a corresponding transceiver $\mathbf{56}_1$–$\mathbf{56}_n$ may be connected to any one of the five ports 72 and receive substantially the same antenna performance. This is because the electrical size of the various feeds 90 remains substantially the same as the frequency varies across the multiband phased array antenna by choosing the correct port 50.

Nonetheless, the transceivers $\mathbf{56}_1$–$\mathbf{56}_n$ may be selectively connected to a particular port 72 within the radial distribution of dipole antenna elements 70*a*, 70*b* to achieve constant beamwidth and pattern control. Similarly, the dipole antenna elements 70 for the different frequency bands may be weighted (e.g., amplitude weighted) to also achieve constant beamwidth and pattern control, as readily appreciated by those skilled in the art.

A single transceiver may be connected to one or more of the five ports 72 on the low-frequency band arrays 64, or multiple transceivers may connected. For example, a first transceiver $\mathbf{56}_1$ operating over the frequency range of 4-to-8 GHz may be connected to port 1, a second transceiver $\mathbf{56}_2$ operating over the frequency range of 8-to-12 GHz may be connected to port 2, and a third transceiver $\mathbf{56}_3$ operating over the frequency range of 12-to-18 GHz may be connected to port 3. Different transceivers $\mathbf{56}_4$–$\mathbf{56}_n$ may likewise be connected to the different ports on the high-frequency band arrays 62.

Since the high and low frequency band arrays 62, 64 operate over different frequency bands, the respective transceivers $\mathbf{56}_1$–$\mathbf{56}_n$ can operate simultaneously. Even though the illustrated low and high frequency bands are continuous (4-to-18 GHz and 18-to-28 GHz), the multiband phased array antenna 50 may be designed to operate over non-continuous frequency bands, as readily appreciated by those skilled in the art. For example, the low-frequency band arrays 64 may still cover 4 to 18 GHz, but the high-frequency band arrays 62 may cover a different frequency band, such as 30 to 33 GHz instead of 18 to 28 GHz, for example.

Referring to FIGS. 7A–7E, and also to FIG. 5, the dipole antenna elements 70*a*, 70*b* as used in the multiband phased array antenna 50 will now be described in greater detail. The dipole antenna elements 70*a*, 70*b* are on a substrate 60, which is a printed conductive layer. Each dipole antenna element 70*a*, 70*b* comprises a medial feed portion (or port) 72 and a pair of legs 74 extending outwardly therefrom. Respective feed lines 90 would be connected to each feed portion 72 from the opposite side of the substrate 60.

Figure 7A:
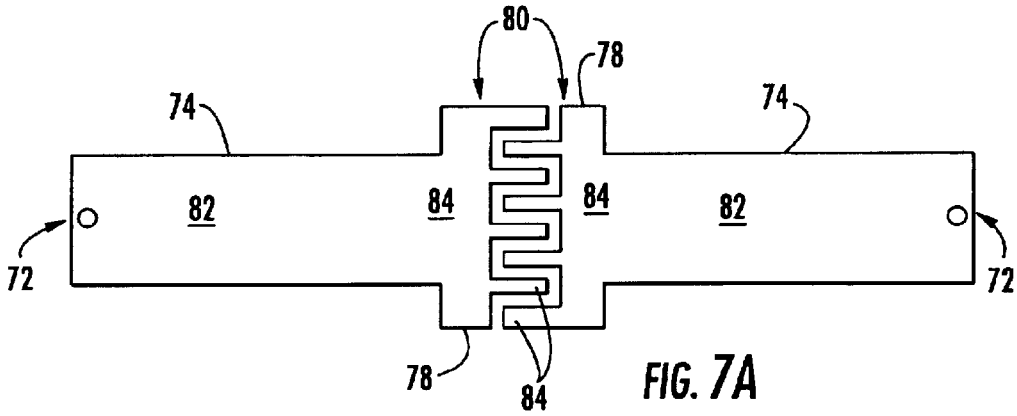
FIGS. 7A and 7B are enlarged schematic views of the spaced apart end portions of adjacent legs of adjacent dipole antenna elements as may be used in the multiband phased array antenna of FIG. 2.

Adjacent legs 74 of adjacent dipole antenna elements 76 have respective spaced apart end portions 78 to provide increased capacitive coupling between the adjacent dipole antenna elements, as shown in FIG. 7A. Increasing the capacitive coupling counters the inherent inductance of the dipole antenna elements when they are closely spaced, and this is done in such a manner that as the frequency varies a wide bandwidth may be maintained.

The adjacent dipole antenna elements 76 have predetermined shapes and relative positioning to provide the increased capacitive coupling. For example, the capacitance between adjacent dipole antenna elements 76 is between about 0.016 and 0.636 picofarads (pF), and preferably between 0.159 and 0.239 pF. Of course, these values will vary as required depending on the actual application to achieve the same desired bandwidth, as readily understood by one skilled in the art.

As shown in FIG. 7A, the spaced apart end portions 78 in adjacent legs 74 may have overlapping or interdigitated portions 80, and each leg 74 comprises an elongated body portion 82, an enlarged width end portion 84 connected to an end of the elongated body portion, and a plurality of fingers, e.g., four, extending outwardly from the enlarged width end portion.

Each dipole antenna element array 62, 64 has a desired frequency range (4 to 18 GHz or 18 to 28 GHz, for example) and the spacing between the end portions 78 of adjacent legs 74 is less than about one-half a wavelength of a highest desired frequency.

Figure 7B:
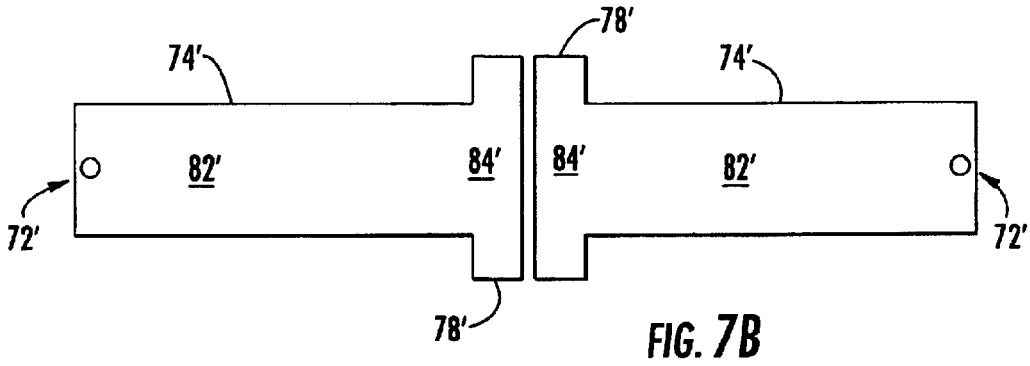

Alternatively, as shown in FIG. 7B, adjacent legs 74' of adjacent dipole antenna elements 76 may have respective spaced apart end portions 78' to provide increased capacitive coupling between the adjacent dipole antenna elements. In this embodiment, the spaced apart end portions 78' in adjacent legs 74' comprise enlarged width end portions 84' connected to an end of the elongated body portion 82' to provide the increased capacitive coupling between adjacent dipole antenna elements 76.

Figure 7C:
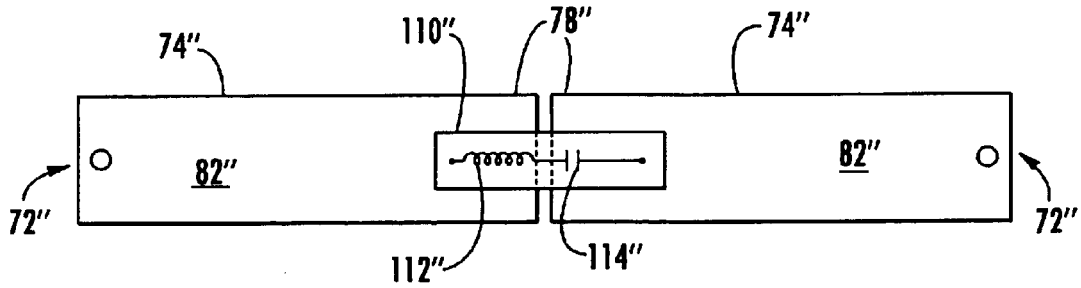
FIG. 7C is an enlarged schematic view of an impedance element connected across the spaced apart end portions of adjacent legs of adjacent dipole antenna elements as may be used in the multiband phased array antenna of FIG. 2.

To further increase the capacitive coupling between adjacent dipole antenna elements 76, a respective discrete or bulk impedance element 110" is electrically connected across the spaced apart end portions 78" of adjacent legs 74" of adjacent dipole antenna elements, as illustrated in FIG. 7C.

In the illustrated embodiment, the spaced apart end portions 78" have the same width as the elongated body portions 82". The discrete impedance elements 110" are preferably soldered in place after the dipole antenna elements 70*a*, 70*b* have been formed so that they overlay the respective adjacent legs 74" of adjacent dipole antenna elements 76. This advantageously allows the same capacitance to be provided in a smaller area, which helps to lower the operating frequency of the respective dipole antenna element arrays 62, 64.

The illustrated discrete impedance element 70" includes a capacitor 112" and an inductor 114" connected together in series. However, other configurations of the capacitor 112" and inductor 114" are possible, as would be readily appreciated by those skilled in the art. For example, the capacitor 112" and inductor 114" may be connected together in parallel, or the discrete impedance element 110" may include the capacitor without the inductor or the inductor without the capacitor. Depending on the intended application, the discrete impedance element 110" may even include a resistor.

The discrete impedance element 110" may also be connected between the adjacent legs 74 with the overlapping or interdigitated portions 80 illustrated in FIG. 7A. In this configuration, the discrete impedance element 110" advantageously provides a lower cross polarization in the antenna patterns by eliminating asymmetric currents which flow in the interdigitated capacitor portions 80. Likewise, the discrete impedance element 110" may also be connected between the adjacent legs 74' with the enlarged width end portions 84' illustrated in FIG. 7B.

Another advantage of the respective discrete impedance elements 110" is that they may have different impedance values so that the bandwidth of the respective dipole antenna element arrays 62, 64 can be tuned for different applications, as would be readily appreciated by those skilled in the art. In addition, the impedance is not dependent on the impedance properties of the adjacent dielectric layer 81. Since the discrete impedance elements 110" are not effected by the dielectric layer 81, this approach advantageously allows the impedance between the dielectric layer 81 and the impedance of the discrete impedance element 110" to be decoupled from one another.

Figure 7D:
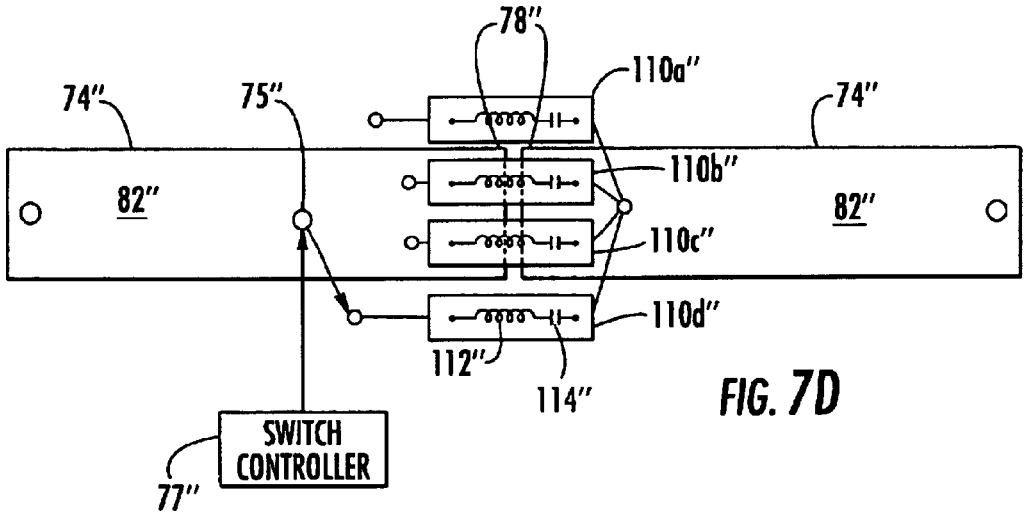
FIG. 7D is an enlarged schematic view of an impedance element selectively connected across the spaced apart end portions of adjacent legs of adjacent dipole antenna elements as may be used in the multiband phased array antenna of FIG. 2.

Yet another aspect of the present invention is directed to selectively coupling a discrete impedance element 110*a"*–110*n"* between a respective pair of adjacent legs 74" of adjacent dipole antenna elements, as illustrated in FIG. 7D. Each dipole antenna element 70*a*, 70*b* has associated therewith a plurality of selectable impedance elements 110*a"*–110*n"* and a corresponding switch 75". The illustrated switch 75" is a single pole multiple throw (SPMT) switch. Alternately, more than one impedance element 110*a"*–110*n"* may be connected at one time to achieve the desired impedance coupling values. In this case, a multiple pole multiple throw (MPMT) switch would be required.

A switch controller 77" is connected to all of the switches 75" in the multiband phased array antenna 50. The switch controller 77" may operate so that the respective impedance elements 110*a"*–110*n"* associated with all of the dipole antenna elements 70*a*, 70*b* are synchronously switched. Alternately, the respective impedance elements 110*a"*–110*n"* for each dipole antenna element 70*a*, 70*b* may be asynchronously switched with respect to the other dipole antenna elements.

The switches 75" and corresponding impedance elements 110*a"*–110*n"* advantageously allow the multiband phased array antenna 50 to be retuned. For example, the frequency band of the phased array antenna may be adjusted, i.e., lower or higher. This adjustment may be as much as 10 to 20 percent of the frequency band depending on the range of the impedance values associated with the impedance elements

110*a*″–110*n*″. In addition, better performance may be achieved at specific frequencies, particularly where the antenna can be better matched, i.e., to operate with a lower VSWR. The active switching may also be combined with the variable height ground plane 80, as readily appreciated by those skilled in the art.

Figure 7E:
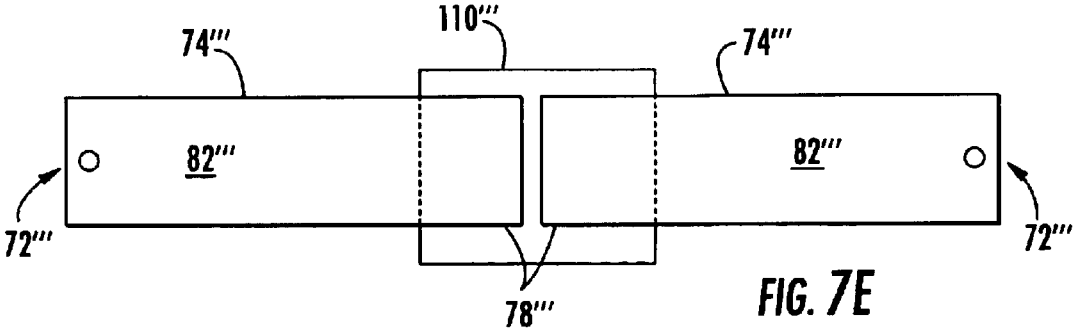
FIG. 7E is an enlarged schematic view of another embodiment of an impedance element connected across the spaced apart end portions of adjacent legs of adjacent dipole antenna elements as may be used in the multiband phased array antenna of FIG. 2.

Yet another approach to further increase the capacitive coupling between adjacent dipole antenna elements 76 includes placing a respective printed impedance element 110‴ adjacent the spaced apart end portions 78‴ of adjacent legs 74‴ of adjacent dipole antenna elements 76, as illustrated in FIG. 7E.

The respective printed impedance elements 110‴ are separated from the adjacent legs 74‴ by a dielectric layer, and are preferably formed before the dipole antenna layer is formed so that they underlie the adjacent legs 74‴ of the adjacent dipole antenna elements 76. Alternatively, the respective printed impedance elements 110‴ may be formed after the dipole antenna layer has been formed. For a more detailed explanation of the printed impedance elements, reference is directed to U.S. patent application Ser. No. 10/308,424 which is assigned to the current assignee of the present invention, and which is incorporated herein by reference.

Figure 8A:
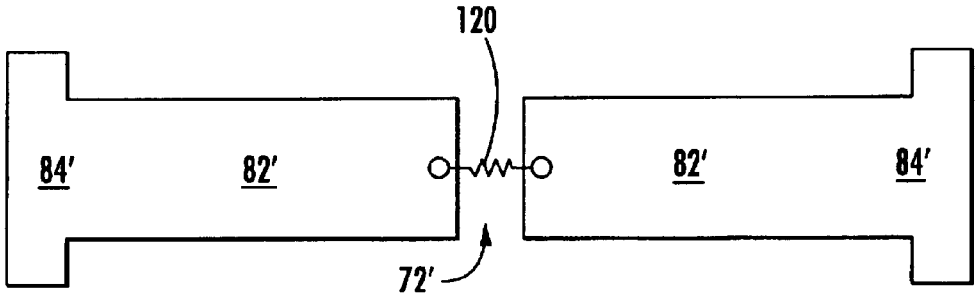
FIGS. 8A and 8B are respectively enlarged schematic views of a discrete resistive element and a printed resistive element connected across the medial feed portion of a dipole antenna element as may be used in the multiband phased array antenna of FIG. 2.
Figure 8B:
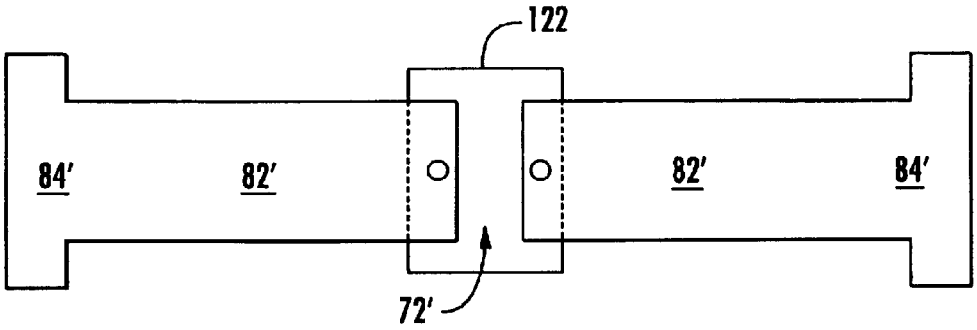

Referring now to FIGS. 8A and 8B, a resistive load may be connected across the medial feed portions 72' of the dipole antenna elements 70*a*', 70*b*' in the outer columns of the respective dipole antenna element arrays 62, 64. As discussed above, the passive elements 70*a*', 70*b*' in the outer columns allow the active elements in the center column to receive sufficient current, which is normally conducted through the dipole antenna elements on the substrate 60.

The resistive load may include a discrete resistor 120, as illustrated in FIG. 8A, or a printed resistive element 122, as illustrated in FIG. 8B. Each discrete resistor 120 is soldered in place after the dipole antenna elements 70*a*, 70*b* have been formed. Alternatively, each discrete resistor 120 may be formed by depositing a resistive paste on the medial feed portions 72, as would be readily appreciated by those skilled in the art.

The respective printed resistive elements 122 may be printed before, during or after formation of the dipole antenna elements 70*a*, 70*b*, as would also be readily appreciated by those skilled in the art. The resistance of the load is typically selected to match the impedance of a feed line connected to an active dipole antenna element, which is in a range of about 50 to 100 ohms.

Figure 9:
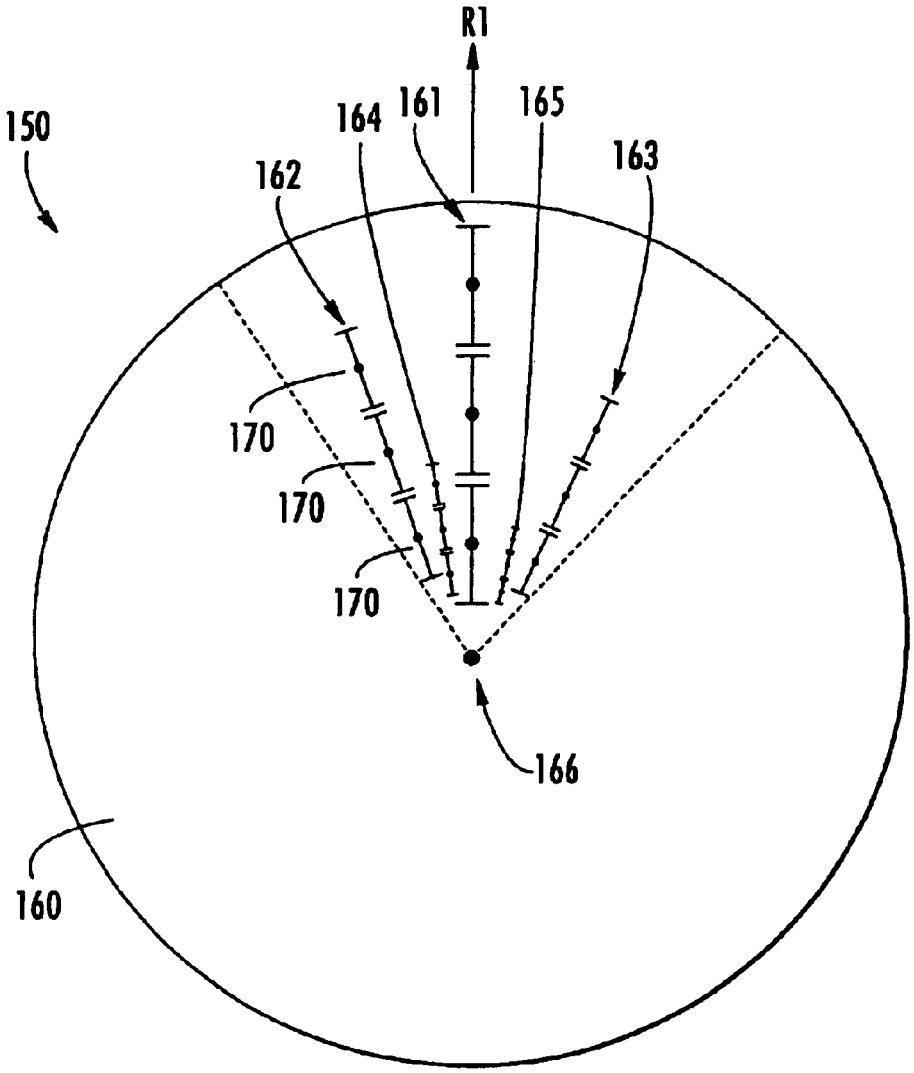
FIG. 9 is top plan view of another aspect of the multiband phased array antenna in accordance with the present invention.

Other aspects of the present invention will now be discussed. One such aspect is still directed to a multiband phased array antenna 150, as illustrated in FIG. 9. The multiband phased array antenna 150 is also a radially distributed phased array antenna covering multiple frequency bands.

However, the multiband phased array antenna 150 comprises a substrate 160, and a plurality of dipole element arrays 161, 162, 163, 164 and 165 extending outwardly from an imaginary center point 166 on the substrate 160. The imaginary center point 166 is not necessarily the center of the substrate 160, but may be slightly off center.

Each dipole element array 161–165 comprises a plurality of dipole antenna elements (generally referred to by reference numeral 170) arranged in end-to-end relation and having a dipole size different than a dipole size of dipole antenna elements of at least one other dipole element array. In other words, each dipole element array 161–165 is sized to cover a respective frequency band so that collectively, the multiband phased array antenna 150 covers a wide bandwidth.

As the dipole element arrays 161–165 decrease from a larger size to a smaller size, the frequency inversely changes, as readily understood by those skilled in the art. For example, the five dipole element arrays may cover the following five frequency bands: 0.1 to 1 GHz for dipole element array 161, 1 to 2 GHz for dipole element array 162, 2 to 4 GHz for dipole element array 163, 4 to 8 GHz for dipole element array 164, and 8 to 16 GHz for dipole element array 165.

Only five dipole element arrays 161–165 within a single "pie" section are illustrated in FIG. 9. Depending on the intended application, the five dipole element arrays 161–165 are repeated in other pie sections around the substrate 160. The distribution of the dipole element arrays 161–165 may be symmetrical, although this is not required. The embodiment of five dipole element arrays 161–165 is for illustrative purposes only, and the actual number of dipole element arrays may vary, as readily appreciated by those skilled in the art.

Each dipole element array 161–165 includes an active dipole antenna element (which is the center element), and may include passive dipole antenna elements adjacent to the active element. The passive dipole antenna elements include a resistive load (not shown) connected across the medial feed portions. The resistive load may be a discrete resistor 120, as illustrated in FIG. 8A, or a printed resistive element 122, as illustrated in FIG. 8B. The passive elements allow the active element in the center to receive sufficient current, which is normally conducted through the dipole antenna elements 170 on the substrate 160.

The actual size of each dipole element array 161–165 may vary, as readily appreciated by those skilled in the art. As illustrated in FIG. 9, each dipole element array 161–165 is a 1 by 3 array. Depending on the intended application, the size of the arrays 161–165 may be adjusted accordingly. For example, a 2 by 3 or a 3 by 5 array would be readily applicable.

Figure 10:
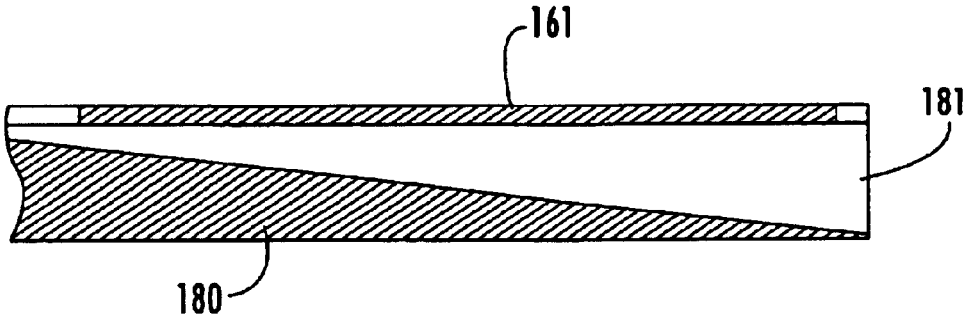
FIG. 10 is a cross-sectional view of the multiband phased array antenna as shown in FIG. 9 taken along radial axis $R_1$.

As noted above, a ground plane for a multiband phased array antenna is preferably spaced from the different size dipole element arrays 161–165 less than about one-half a wavelength of a highest desired frequency within each respective array. Referring now to FIG. 10, a cross-sectional view of the multiband phased array antenna 150 as shown in FIG. 9 is taken along radial axis $R_1$. The ground plane 180 has a different spacing from the plurality of dipole element arrays 161–165 in an outward direction from the imaginary center point 166.

In other words, the illustrated ground plane 180 is sloping so that the spacing between the ground plane and the dipole element arrays 161–165 increases. Alternately, the dipole element arrays 161–165 may be positioned so that the spacing between the ground plane 180 and the dipole element arrays 161–165 decreases. When the slope of the ground plane 180 increases, the lower frequency arrays are positioned on the substrate 160 further away from the imaginary center point 166, whereas the higher frequency arrays are positioned closer to the imaginary center point. Furthermore, the position of each dipole element array 161–165 on the substrate 160 may also be radially adjusted for the different frequency bands to achieve a constant beamwidth across the total bandwidth.

The slope of the ground plane 180 does not necessarily have to be constant. For example, the slope of the ground plane 180 may be logarithmic or exponential. In this case, position of the dipole element arrays 161–165 would be adjusted accordingly to provide the preferred spacing between the ground plane 180 and the respective dipole antenna elements 170 based upon their size. A dielectric material 181 is between the ground plane 180 and the respective dipole antenna elements 170.

Figure 11A:
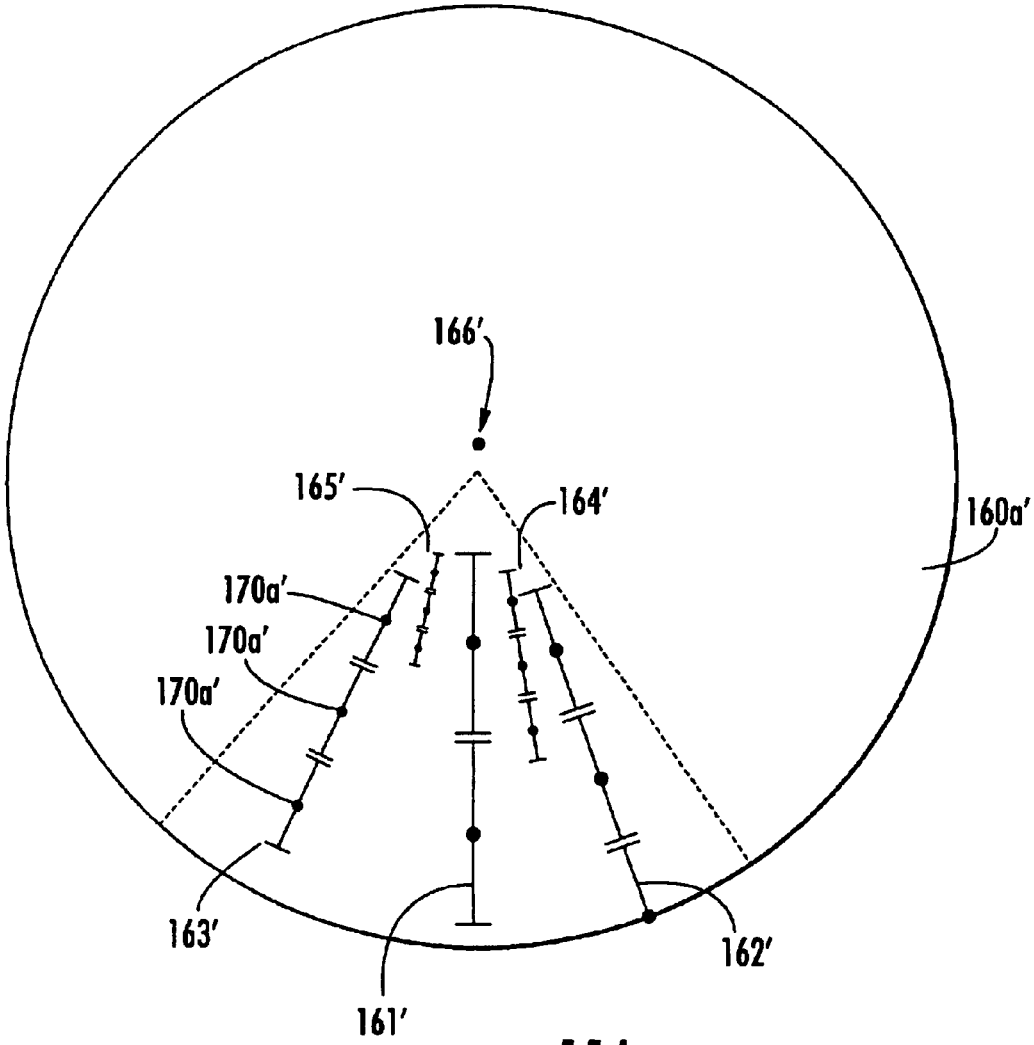
FIGS. 11A and 11B are respectively a top plan view and a corresponding side view of another embodiment of the multiband phased array antenna as shown in FIG. 9.
Figure 11B:
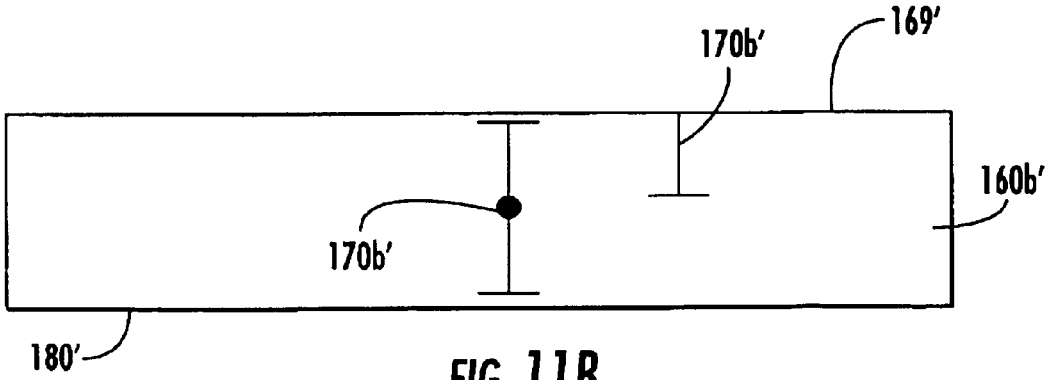

Depending on the desired overall size of the multiband phased array antenna 150, crowding of the dipole antenna elements 170 within each pie section on the substrate 160 could be a problem. One approach to alleviating this problem is to turn the outermost passive dipole antenna elements near the edge of the substrate 90 degrees, as illustrated in FIGS. 11A (top view) and 11B (side view).

In this embodiment of the multiband phased array antenna 150', the substrate has a first surface 160*a*', and a second surface 160*b*' adjacent thereto and defining an edge 169' therebetween. In the illustrated embodiment, the second surface 160*b*' is orthogonal to the first surface 160*a*'. The substrate 160*a*', 160*b*' may be a monolithic flexible substrate, and the second surface is formed by simply bending the substrate so that one of the legs of the edge elements 170*b*' extends onto the second surface.

Dipole element arrays 163', 164' and 165' extend outwardly from the imaginary center point 166' only the first surface 160*a*' of the substrate 160*a*', and dipole element arrays 161' and 162' extend outwardly from the imaginary center point 166' on both the first and second surfaces 160*a*', 160*b*' of the substrate. The dipole antenna elements on the first surface of the substrate 160*a*' are indicated by reference 170*a*', whereas the dipole antenna elements on the second surface of the substrate 160*b*' (partially or fully thereon) are indicated by reference 170*b'*.

Figure 12:
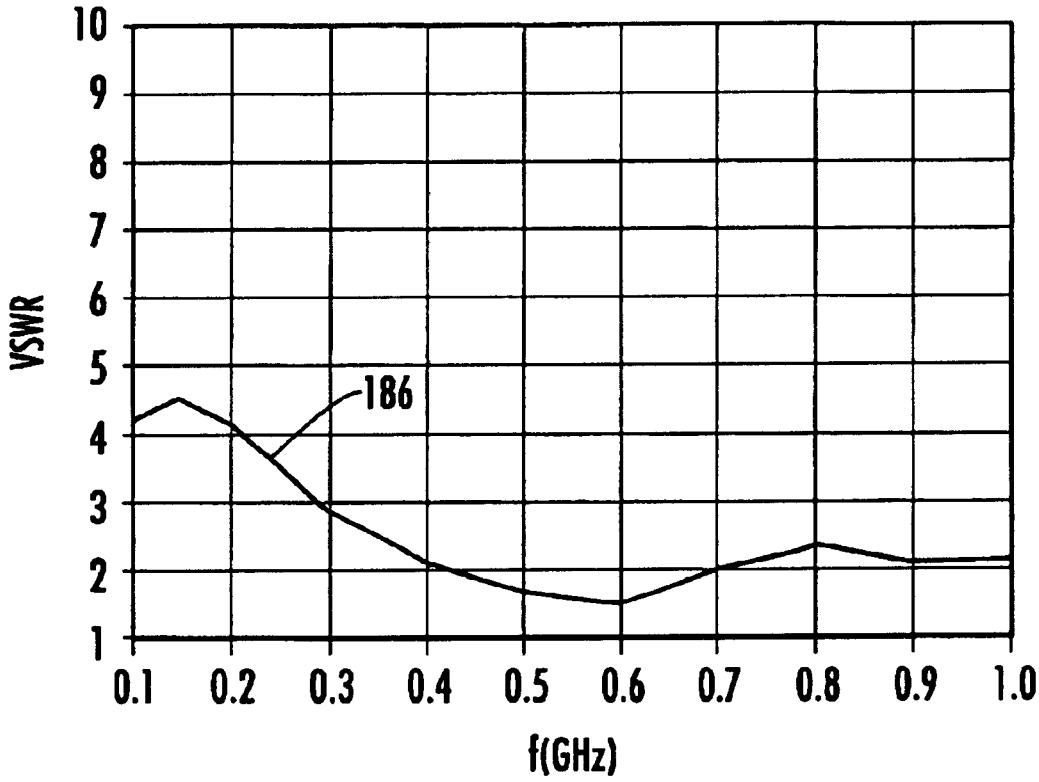
FIG. 12 is a plot of the computed VSWR versus frequency for one of the dipole element arrays having an edge element on a second surface of the substrate as shown in FIG. 11B.

The dipole antenna elements 170*b*' on the second surface 160*b*' of the substrate may also be referred to as "edge elements." A plot of the computed VSWR versus frequency for the low frequency dipole element array 161' having a dipole antenna element 170*b*' on the second surface 160*b*' of the substrate is represented by line 186 in FIG. 12.

Figure 13:
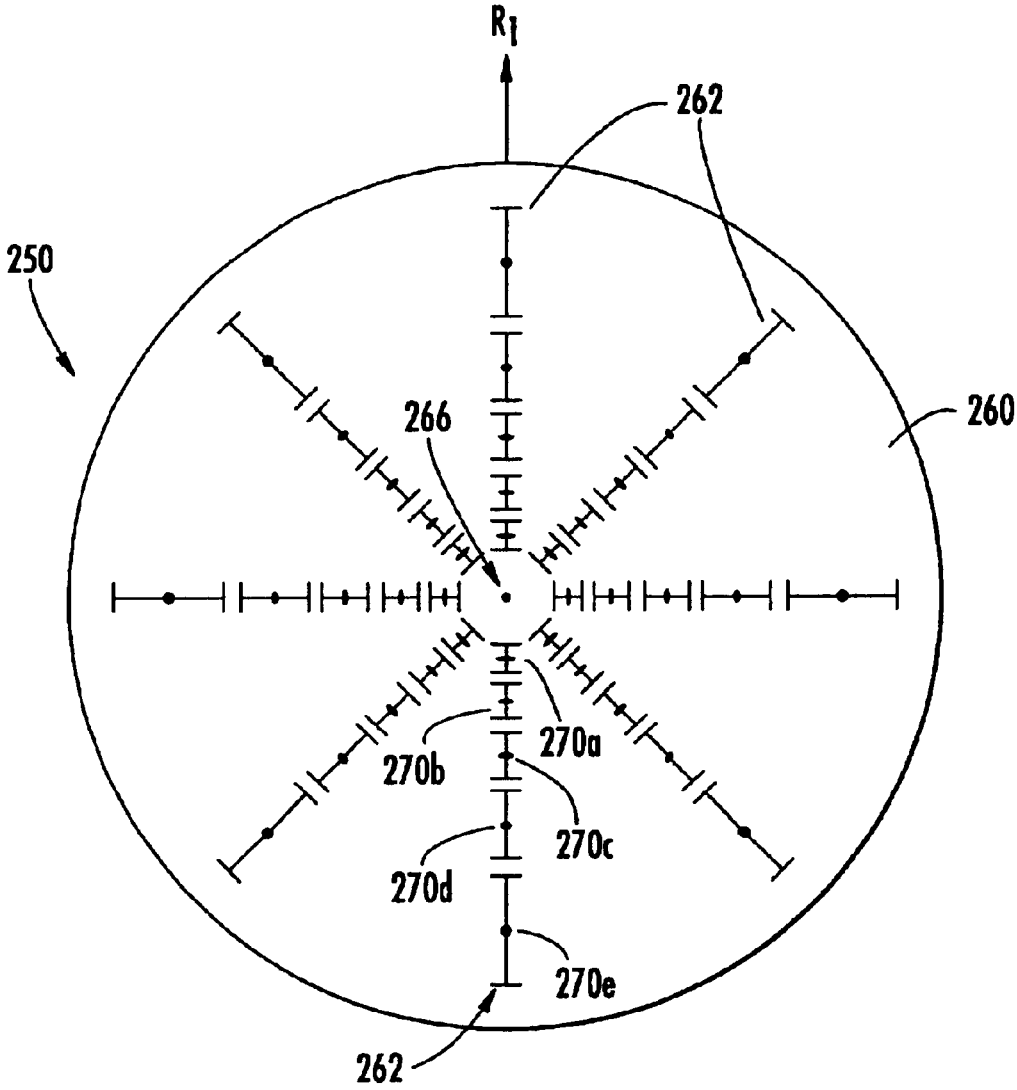
FIG. 13 is top plan view of another aspect of the multiband phased array antenna in accordance with the present invention.

Another aspect of the present invention is directed to a multiband phased array antenna 250, as illustrated in FIG. 13. The multiband phased array antenna 250 is also a radially distributed phased array antenna covering multiple frequency bands. In particular, the multiband phased array antenna 250 comprises a substrate 260, and a plurality of dipole element arrays 262 extending outwardly from an imaginary center point 266 on the substrate. The distribution of the dipole element arrays 262 may be symmetrical, although this is not required.

Each dipole element array 262 comprises a plurality of dipole antenna elements 270*a*–270*e* arranged in end-to-end relation and having different dipole sizes for dipole antenna elements in a direction extending outwardly from the imaginary center point 266. In other words, the multiband phased array antenna 250 is "graded" in the sense that the size of the dipole antenna elements 270*a*–270*e* changes from the imaginary center point 266 toward the outer edge of the substrate 260.

Each illustrated dipole element array 262 comprises five active dipole antenna elements 270*a*–270*e*. The actual number of elements could vary depending on the intended application. The multiband phased array antenna 250 may cover the following frequency bands: dipole antenna element 270*a* covers 0.1 to 1 GHz, dipole antenna element 270*b* covers 1 to 2 GHz, dipole antenna element 270*c* covers 2 to 4 GHz, dipole antenna element 270*d* covers 4 to 8 GHz and dipole antenna element 270*e* covers 8 to 16 GHz. Of course, the active dipole antenna elements 270*a*–270*e* vary in size to cover different frequency bands, as readily appreciated by those skilled in the art.

Figure 14:
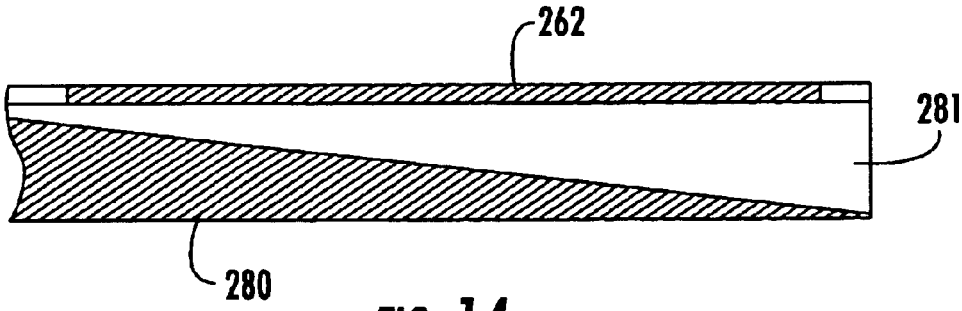
FIG. 14 is a cross-sectional view of the multiband phased array antenna as shown in FIG. 13 taken along radial axis $R_1$.

As noted above, a ground plane for a multiband phased array antenna is preferably spaced from the different size dipole element arrays 262 less than about one-half a wavelength of a highest desired frequency within each respective array. Referring now to FIG. 14, a cross-sectional view of the multiband phased array antenna 250 as shown in FIG. 13 is taken along radial axis $R_1$. The ground plane 280 has a different spacing from the different dipole antenna elements 270*a*–270*e* in the plurality of dipole element arrays 262.

The illustrated ground plane 280 is sloping so that the spacing between the ground plane and the dipole antenna elements 270*a*–270*e* increases-as you move from the imaginary center point 266 toward the outer edge of the substrate 260. Consequently, the lower frequency dipole antenna elements 270*d* and 270*e* are positioned on the substrate 260 further away from the imaginary center point 266, whereas the higher frequency dipole antenna elements 270*a*, 270*b* and 270*c* are positioned closer to the imaginary center point.

The transceivers $\mathbf{56}_1$–$\mathbf{56}_n$ may be selectively connected to a particular port within the radial distribution of dipole antenna elements 270*a*–270*e* to achieve constant beamwidth and pattern control. Although not illustrated in FIG. 13, passive elements may be connected to the innermost and outermost dipole antenna elements 270*a*, 270*e* to increase bandwidth. In addition, each dipole element array 262 is not limited to a 1×5 matrix of dipole antenna elements, and other size arrays are acceptable, as readily appreciated by those skilled in the art.

As noted above, the slope of the ground plane 280 does not necessarily have to be constant. For example, the slope of the ground plane 280 may be logarithmic or exponential. In this case, position of the dipole element arrays 262 would be adjusted accordingly to provide the preferred spacing between the ground plane 280 and the respective dipole antenna elements 270*a*–270*c* based upon their size. A dielectric material 281 is between the ground plane 280 and the respective dipole antenna elements 270*a*–270*e*.

Figure 16:
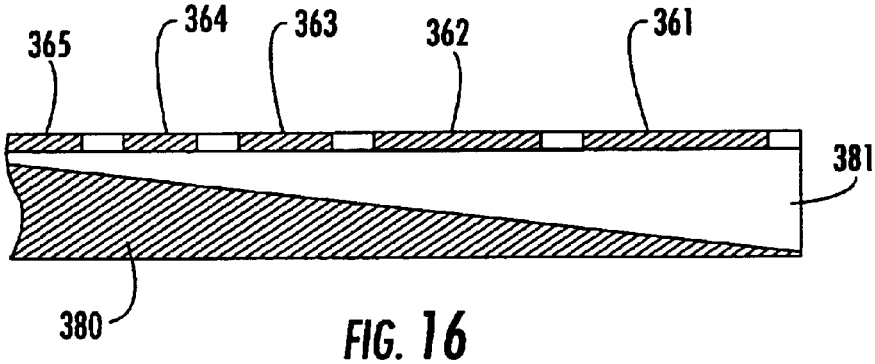
FIG. 16 is a cross-sectional view of the multiband phased array antenna as shown in FIG. 15 taken along radial axis $R_1$.

Yet another aspect of the present invention is directed to a multiband phased array antenna 350, as illustrated in FIG. 16. In particular, the multiband phased array antenna 350 comprises a substrate 360, and a plurality of dipole element arrays 361, 362, 363, 364 and 365 extending in concentric polygonal rings about an imaginary center point 366 on the substrate.

The plurality of dipole element arrays 361–365 are concentric about the imaginary center point 366. This is in contrast to the dipole element arrays in the multiband phased array antennas 50, 150 and 250 as discussed above, which are all radially distributed with respect to an imaginary center point.

Each dipole element array 361–365 comprises a plurality of dipole antenna elements 370*a*-370*e* arranged in an end-to-end relation and having a dipole size different than a dipole size of dipole antenna elements of at least one other dipole element array. The specific features of the dipole antenna elements as discussed above are also applicable to the multiband phased array antenna 350, and will not be discussed in any greater detail.

In the illustrated embodiment, each concentric polygonal ring (i.e., a dipole element array) includes N individual dipole antenna elements, wherein N=8. The actual number N of individual dipole antenna elements can vary depending on the intended application. For example, the lower limit of N may be 3, and the upper end of N may be determined by the intended application.

Figure 17:
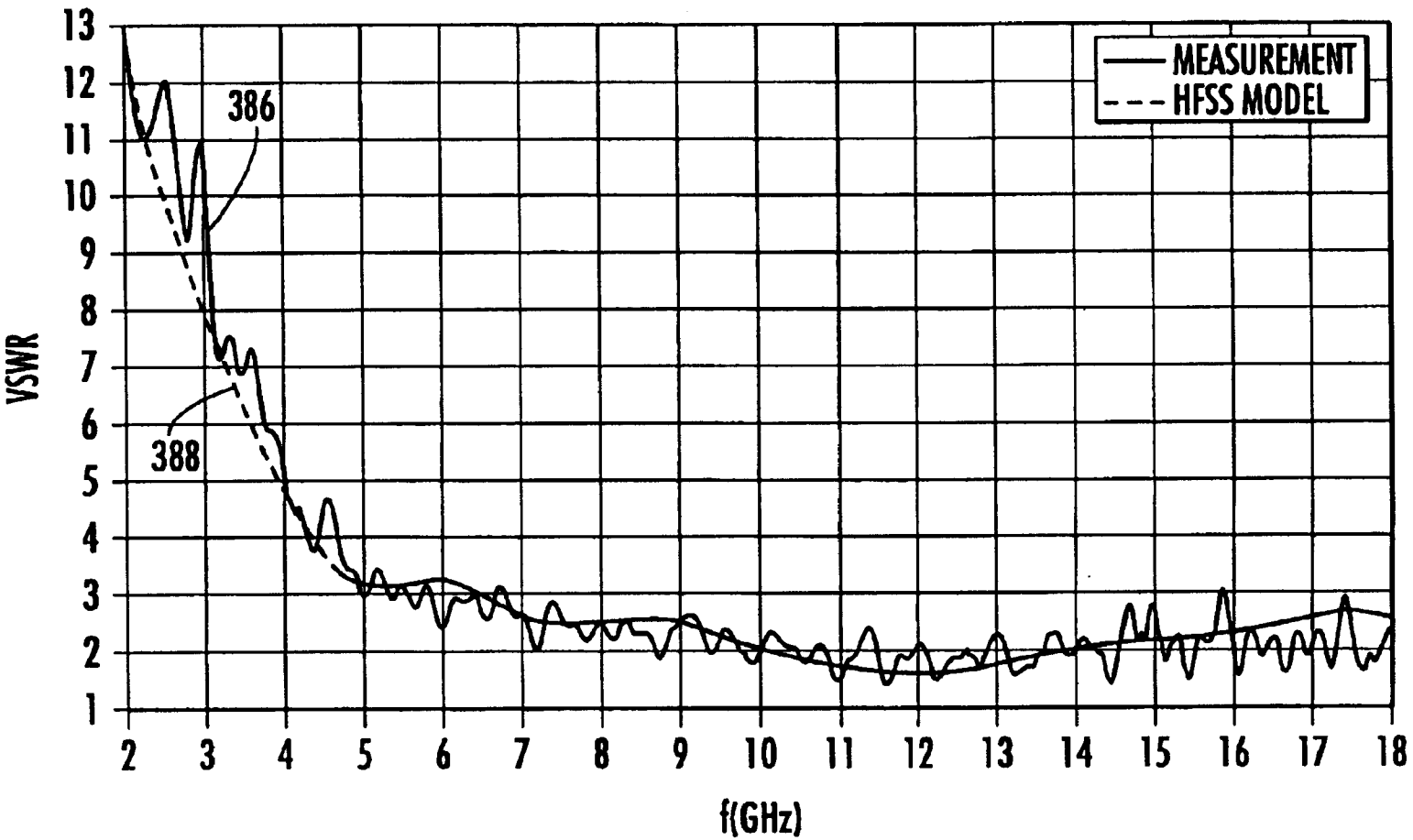
FIG. 17 is a plot of measured and computed VSWR versus frequency over a frequency range of 2 to 18 GHz for the multiband phased array antenna as shown in FIG. 16.

The ground plane 380 for the multiband phased array antenna 350 is preferably spaced from the different size dipole element arrays 361–365 less than about one-half a wavelength of a highest desired frequency within each respective array. Referring now to FIG. 17, a cross-sectional view of the multiband phased array antenna 350 as shown in FIG. 16 is taken along radial axis $R_1$. The ground plane 380 has a different spacing from the different dipole antenna elements 370*a*–370*e* in the plurality of dipole element arrays 361–365.

The illustrated ground plane 380 is sloping so that the spacing between the ground plane and the dipole antenna elements 370*a*–370*e* increases as you move from the imaginary center point 366 toward the outer edge of the substrate 360. Consequently, the lower frequency dipole antenna elements 370*a*, 370*b* (i.e., arrays 361, 362) are positioned on the substrate 360 further away from the imaginary center point 366, whereas the higher frequency dipole antenna elements 370*a*, 370*b*, 370*c* (i.e., 363, 364, 365) are positioned closer to the imaginary center point.

The transceivers $\mathbf{56}_1$–$\mathbf{56}_n$ may be selectively connected to a particular concentric ring to achieve constant beamwidth and pattern control. As noted above, the slope of the ground plane 380 does not necessarily have to be constant. For example, the slope of the ground plane 380 may be logarithmic, exponential, or stepped. In this case, position of the dipole element arrays would be adjusted accordingly to provide the preferred spacing between the ground plane 380 and the respective dipole antenna elements 370*a*–370*e* based upon their size. A dielectric material 381 is between the ground plane 380 and the respective dipole antenna elements 370*a*–370*e*.

Figure 15:
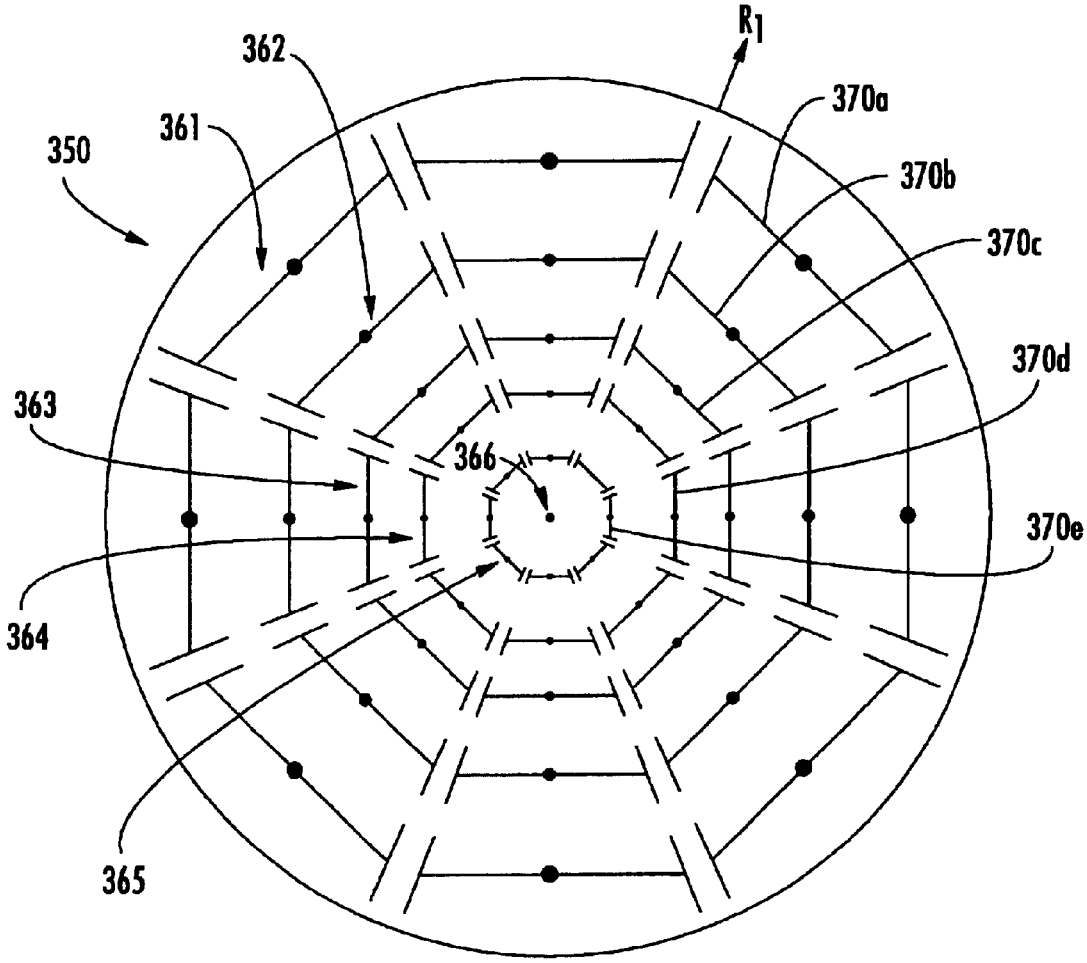
FIG. 15 is top plan view of another aspect of the multiband phased array antenna in accordance with the present invention.

The concentric rings are illustrated as being circumscribed in a circle, but they may also be circumscribed in any other shape, such as an ellipse. The concentric rings may also be triangular or rectangular, as readily appreciated by those skilled in the art. In addition, the spacing of the concentric rings may be symmetrical, as shown in FIG. 15.

Measured and computed VSWR versus frequency over a frequency band of 2 to 18 GHz for the multiband phased array antenna 350 is provided in FIG. 17. Line 386 represents the measured VSWR, whereas line 388 represents the computed VSWR. The measured and computed VSWR versus frequency is relatively constant between 8 and 18 GHz.

In addition, other features relating to the multiband phased array antennas are disclosed in copending patent applications filed concurrently herewith and assigned to the assignee of the present invention and are entitled PHASED ARRAY ANTENNA WITH SELECTIVE CAPACITIVE COUPLING AND ASSOCIATED METHODS, attorney docket number GCSD-1493 (51349); MULTIBAND RADIALLY DISTRIBUTED GRADED PHASED ARRAY ANTENNA AND ASSOCIATED METHODS, attorney docket number GCSD-1487 (51351); MULTIBAND RADIALLY DISTRIBUTED PHASED ARRAY ANTENNA WITH A SLOPING GROUND PLANE AND ASSOCIATED METHODS, attorney docket number GCSD-1486 (51352); and MULTIBAND RADIALLY DISTRIBUTED PHASED ARRAY ANTENNA WITH A STEPPED GROUND PLANE AND ASSOCIATED METHODS, attorney docket number GCSD-1485 (51353), the entire disclosures of which are incorporated herein in their entirety by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A multiband phased array antenna comprising:

a substrate; and a plurality of dipole element arrays extending in rings about an imaginary center point on said substrate;

each dipole element array comprising a plurality of dipole antenna elements arranged in end-to-end relation and having a dipole size different than a dipole size of dipole antenna elements of at least one other dipole element array.

2. A multiband phased array antenna according to claim 1, wherein the rings are symmetrically distributed about the imaginary center point.

3. A multiband phased array antenna according to claim 1, wherein the rings are concentric about the imaginary center point.

4. A multiband phased array antenna according to claim 1, wherein the dipole sizes in each respective ring are a same size.

5. A multiband phased array antenna according to claim 1, wherein the dipole sizes in each respective ring increases in an outward direction from the imaginary center point with respect to the dipole sizes in the other rings.

6. A multiband phased array antenna according to claim 1, further comprising a ground plane adjacent said plurality of dipole element arrays, and a spacing between said plurality of dipole element arrays and said ground plane is different between the dipole element arrays having different size dipole antenna elements.

7. A multiband phased array antenna according to claim 6, wherein the different spacing between said ground plane and said plurality of dipole element arrays increases in the outward direction from the imaginary center point.

8. A multiband phased array antenna according to claim 1, wherein each dipole antenna element comprises a printed conductive layer.

9. A multiband phased array antenna according to claim 1, wherein said plurality of dipole antenna elements are sized and relatively positioned within each respective dipole element array so that the multiband phased array antenna has a total bandwidth equal to or greater than 20-to-1.

10. A multiband phased array antenna according to claim 1, wherein each dipole antenna element comprises a medial feed portion and a pair of legs extending outwardly therefrom, adjacent legs of adjacent dipole antenna elements including respective spaced apart end portions having predetermined shapes and relative positioning to provide increased capacitive coupling between the adjacent dipole antenna elements.

11. A multiband phased array antenna according to claim 10, wherein each leg comprises:

an elongated body portion; and an enlarged width end portion connected to an end of the elongated body portion.

12. A multiband phased array antenna according to claim 10, wherein each leg comprises:

an elongated body portion;

an enlarged width end portion connected to an end of the elongated body portion; and a plurality of fingers extending outwardly from said enlarged width end portion.

13. A multiband phased array antenna according to claim 10, wherein each dipole element array has a desired frequency range, and wherein the spacing between the end portions of adjacent legs is less than about one-half a wavelength of a highest desired frequency.

14. A multiband phased array antenna according to claim 10, further comprising a respective impedance element electrically connected between the spaced apart end portions of adjacent legs of adjacent dipole antenna elements for further increasing the capacitive coupling therebetween.

15. A multiband phased array antenna according to claim 10, further comprising a respective printed impedance element adjacent the spaced apart end portions of adjacent legs of adjacent dipole antenna elements for further increasing the increased capacitive coupling therebetween.

16. A multiband phased array antenna comprising:

a substrate;

a plurality of dipole element arrays extending in rings about an imaginary center point on said substrate;

each dipole element array comprising a plurality of dipole antenna elements arranged in end-to-end relation and having a dipole size different than a dipole size of dipole antenna elements of at least one other dipole element array; and a ground plane adjacent said plurality of dipole element arrays, and a spacing between said plurality of dipole element arrays and said ground plane is different between the dipole element arrays having different size dipole antenna elements.

17. A multiband phased array antenna according to claim 16, wherein the rings are symmetrically distributed about the imaginary center point.

18. A multiband phased array antenna according to claim 16, wherein the dipole sizes in each respective ring are a same size.

19. A multiband phased array antenna according to claim 16, wherein the dipole sizes in each respective ring increase in an outward direction from the imaginary center point.

20. A multiband phased array antenna according to claim 16, wherein the different spacing between said ground plane and said plurality of dipole element arrays increases in the outward direction from the imaginary center point.

21. A multiband phased array antenna according to claim 16, wherein said plurality of dipole antenna elements are sized and relatively positioned within each respective dipole element array so that the multiband phased array antenna has a total bandwidth equal to or greater than 20-to-1.

22. A multiband phased array antenna according to claim 16, wherein each dipole antenna element comprises a medial feed portion and a pair of legs extending outwardly therefrom, adjacent legs of adjacent dipole antenna elements including respective spaced apart end portions having predetermined shapes and relative positioning to provide increased capacitive coupling between the adjacent dipole antenna elements.

23. A multiband phased array antenna according to claim 22, wherein each leg comprises:

an elongated body portion; and an enlarged width end portion connected to an end of the elongated body portion.

24. A multiband phased array antenna according to claim 22, wherein each leg comprises:

an elongated body portion;

an enlarged width end portion connected to an end of the elongated body portion; and a plurality of fingers extending outwardly from said enlarged width end portion.

25. A multiband phased array antenna according to claim 22, further comprising a respective impedance element electrically connected between the spaced apart end portions of adjacent legs of adjacent dipole antenna elements for further increasing the capacitive coupling therebetween.

26. A multiband phased array antenna according to claim 22, further comprising a respective printed impedance element adjacent the spaced apart end portions of adjacent legs of adjacent dipole antenna elements for further increasing the capacitive coupling.

27. A method for making a multiband phased array antenna comprising:

providing a substrate; and forming a plurality of dipole element arrays extending in rings about an imaginary center point on the substrate, each dipole element array comprising a plurality of dipole antenna elements arranged in end-to-end relation and having a dipole size different than a dipole size of dipole antenna elements of at least one other dipole element array.

28. A method according to claim 27, wherein the rings are symmetrically distributed about the imaginary center point.

29. A method according to claim 27, wherein the dipole sizes in each respective ring are a same size.

30. A method according to claim 27, wherein the dipole sizes in each respective ring increases in an outward direction from the imaginary center point with respect to the dipole sizes in the other rings.

31. A method according to claim 27, further comprising forming a ground plane adjacent the plurality of dipole element arrays, and a spacing between the plurality of dipole element arrays and the ground plane is different between the dipole element arrays having different size dipole antenna elements.

32. A method according to claim 31, wherein the different spacing between the ground plane and the plurality of dipole element arrays increases in the outward direction from the imaginary center point.

33. A method according to claim 27, wherein forming each dipole antenna element comprises forming a medial feed portion and a pair of legs extending outwardly therefrom, with adjacent legs of adjacent dipole antenna elements including respective spaced apart end portions having predetermined shapes and relative positioning to provide increased capacitive coupling between the adjacent dipole antenna elements.

34. A method according to claim 33, wherein forming each leg comprises forming an elongated body portion, and forming an enlarged width end portion connected to an end of the elongated body portion.

35. A method according to claim 33, wherein forming the spaced apart end portions in adjacent legs comprises forming interdigitated portions.

36. A method according to claim 33, wherein forming each leg comprises forming an elongated body portion, forming an enlarged width end portion connected to an end of the elongated body portion, and forming a plurality of fingers extending outwardly from the enlarged width end portion.

37. A method according to claim 33, wherein each dipole element array has a desired frequency range, and wherein the spacing between the end portions of adjacent legs is less than about one-half a wavelength of a highest desired frequency.

38. A method according to claim 33, further comprising electrically connecting a respective impedance element between the spaced apart end portions of adjacent legs of adjacent dipole antenna elements for further increasing the capacitive coupling therebetween.

39. A method according to claim 33, further comprising forming a respective printed impedance element adjacent the spaced apart end portions of adjacent legs of adjacent dipole antenna elements for further increasing the increased capacitive coupling therebetween.

* * * * *

UNITED STATES PATENT AND TRADEMARK OFFICE

CERTIFICATE OF CORRECTION

PATENT NO. : 6,943,748 B2
DATED : September 13, 2005
INVENTOR(S) : Durham et al.

It is certified that error appears in the above-identified patent and that said Letters Patent is hereby corrected as shown below:

Column 3,
Line 63, delete “is top”, insert -- is a top --.

Column 4,
Lines 7 and 13, delete “is top”, insert -- is a top --.

Column 6,
Line 55, delete “may connected”, insert -- may be connected --.

Column 11,
Line 23, delete “surface 160a’ of”, insert -- surface of --.

Column 12,
Line 12, delete “increases-as”, insert -- increases as --.

Signed and Sealed this

Twenty-first Day of February, 2006

JON W. DUDAS
*Director of the United States Patent and Trademark Office*